United States Patent [19]

Harvey et al.

[11] Patent Number: 4,645,978

[45] Date of Patent: Feb. 24, 1987

[54] RADIAL GEOMETRY ELECTRON BEAM CONTROLLED SWITCH UTILIZING WIRE-ION-PLASMA ELECTRON SOURCE

[75] Inventors: Robin J. Harvey, Thousand Oaks; Hayden E. Gallagher, Malibu, both of Calif.

[73] Assignee: Hughes Aircraft Company, Los Angeles, Calif.

[21] Appl. No.: 621,579

[22] Filed: Jun. 18, 1984

[51] Int. Cl.[4] ..... H01J 7/24

[52] U.S. Cl. ..... 315/111.81; 313/163; 313/567; 315/39; 315/261; 315/342

[58] Field of Search ..... 315/39, 111.81, 261, 315/342; 313/163, 567, 233

[56] References Cited

U.S. PATENT DOCUMENTS

| | | | |
|---|---|---|---|
| 2,263,958 | 11/1941 | Strobel | 315/261 |
| 3,093,766 | 6/1963 | Cobine | 313/233 |
| 3,360,678 | 12/1967 | Kerns | 315/39 |
| 3,509,404 | 4/1970 | Rich | 313/233 |
| 4,034,260 | 7/1977 | Lutz | 315/344 |
| 4,394,622 | 7/1983 | Rink | 315/39 |
| 4,507,589 | 3/1985 | Prono et al. | 315/111.81 |

*Primary Examiner*—Harold Dixon

*Attorney, Agent, or Firm*—Victor G. Laslo; A. W. Karambelas

[57] ABSTRACT

An electron beam controlled switch employing a radial geometry and a Wire-Ion Plasma-Electron gun (WIP E-gun) as an electron source is disclosed. The switch comprises an inner cylinder that serves as the WIP E-gun cathode, a cylindrical grid that serves as the WIP E-gun anode, an array of fine wire anodes disposed in the WIP E-gun ionization chamber, a foil support cylinder to support the foil windows which also serve as the switch anode, and an outer cylinder which also serves as the switch cathode. The WIP E-gun and ionization chamber is gas filled at low pressure, while the switch cavity is filled with a high pressure gas. A voltage pulse is applied to the wire anodes to ionize the gas in the ionization chamber. The ions are extracted through the chamber grid and accelerated through a high voltage to bombard the E-gun cathode. The electrons emitted from the ion bombardment are accelerated outwardly through the high voltage, penetrate through the foil windows and into the pressurized gas in the switch cavity. The high energy electrons ionize the gas between the switch anode and cathode, thereby turning "ON" the switch. In the absence of the electron beam, the switch gas deionizes and switch conduction is quickly extinguished.

22 Claims, 13 Drawing Figures

Fig. 1
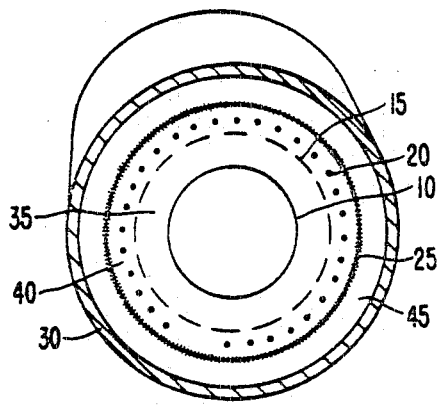
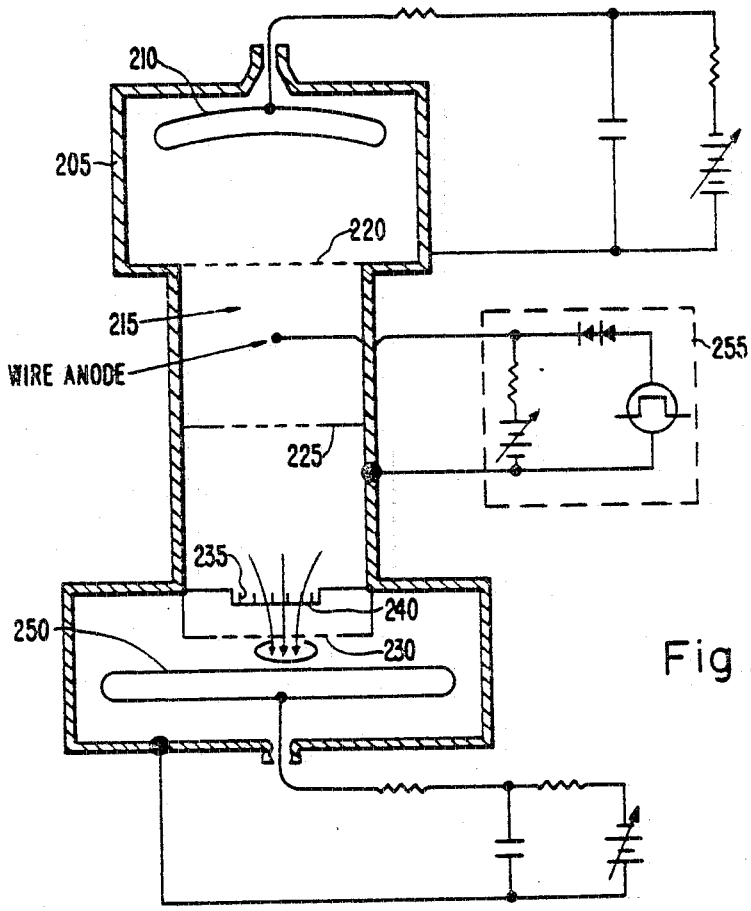
Fig. 2.

RADIAL GEOMETRY ELECTRON BEAM CONTROLLED SWITCH UTILIZING WIRE-ION-PLASMA ELECTRON SOURCE

BACKGROUND OF THE INVENTION

The present invention relates to high power, high voltage systems for switching large currents, and more particularly to such systems employing plasma sources controlled by electron beams.

Electron Beam Controlled Switches (EBCS) have beem employed in high voltage, high power switching applications. Typically, prior art systems employ a switch with a thermionic cathode (at high temperature) with planar arrangement of the EBCS. It is understood by applicants that the Westinghouse Corporation has employed a Wire-Ion-Plasma Electron-gun (WIP E-gun) as the electron source with a planar arrangement of an EBCS. WIP E-gun are discussed, for example in U.S. Pat. Nos. 4,025,818 and 3,970,892, entitled "Wire Ion Plasma Electron Gun" and "Ion Plasma Electron Gun", respectively.

U.S. Pat. No. 4,063,130, "Low Impedance Electron Beam Controlled Discharge Switching Device" issued to Robert O. Hunter, Jr., discloses a switch comprising a gas discharge device and an electron gun with planar electrodes which may be circularly symmetrical about a common axis of rotation. However, the patent is not understood to disclose a WIP E-gun as the electron source. The cold cathode (over-voltage vacuum diode) electron gun described in the Hunter patent is understood to be operable primarily for pulsed operation, such that the switch could not be adapted to conduction of large currents for sustained periods. Further, to turn the electron beam "OFF", the voltage supply for the electron gun must be turned "OFF".

Various other problems are associated with the switches of the prior art. For example, thermionic devices require heater cathode power, a heater supply, a grid pulser operating at high voltage, and means for maintaining a sensitive high temperature cathode so that it remains active in a harsh environment. Thermonic cathodes require a very high vacuum environment and are easily contaminated. Field emitting cathodes, such as the Hunter device, operate only for short pulses. The known EBCS devices require a large active area to carry the typical switch currents, and the physical size of planar EBCS devices may be quite large. X-ray shielding is a major design and weight consideration in these EBCS prior art devices.

It is, therefore, an object of the present invention to provide an EBCS which is superior to other types of switches for many high power applications.

Another object of the invention is to provide a switch which is compact and highly efficient.

A further object is to provide an EBCS device which minimizes the required shielding of X-ray.

Yet another object of the invention is to provide a WIP E-gun having a radial geometry.

A further object of the invention is to provide a radial geometry EBCS employing a WIP E-gun as the electron source.

Another object of the invention is to provide a switch having the capability to turn "OFF" under load, i.e., against a high voltage.

SUMMARY OF THE INVENTION

An Electron Beam Controlled Switch (EBCS) incorporating a WIP E-gun as the electron source of the controlling electron beam is disclosed. Both the EBCS and WIP E-gun employ a radial geometry. The EBCS comprises an inner cylinder comprising the WIP E-gun cathode, a cylindrical grid that serves as the WIP E-gun anode, an array of fine wire anodes that run the length of the cylinders, a foil support cylinder for the foil windows which also serve as the switch anode, and an outer cylinder comprising the switch cathode. The WIP E-gun and ionization chamber containing the wire anodes are gas filled at low pressure. A voltage pulse is applied to the wire anodes to ionize the gas. The resulting ions are extracted through the E-gun anode grid and are accelerated through a high voltage to bombard the E-gun cathode. The electrons emitted from the ion bombardment are accelerated outwardly through the high voltage and these high energy electrons penetrate through the foil windows and into the high pressure gas in the switch cavity. The high energy electrons ionize the gas between the switch anode and cathode, thereby turning "ON" the switch. In the absence of the electron beam, the switch gas deionizes and switch conduction is quickly extinguished.

Other features and improvements are disclosed.

BRIEF DESCRIPTION OF THE DRAWINGS

These and other features and advantages of the present invention will become more apparent from the following detailed description of an exemplary embodiment thereof, as illustrated in the accompanying drawings, in which:

FIG. 1 is a perspective conceptual view illustrating the radial geometry of the EBCS of the invention.

FIG. 2 is a schematic drawing of a planar EBCS employing a WIP E-gun as the controlled electron beam source.

DETAILED DESCRIPTION OF THE INVENTION

Figure 3A:
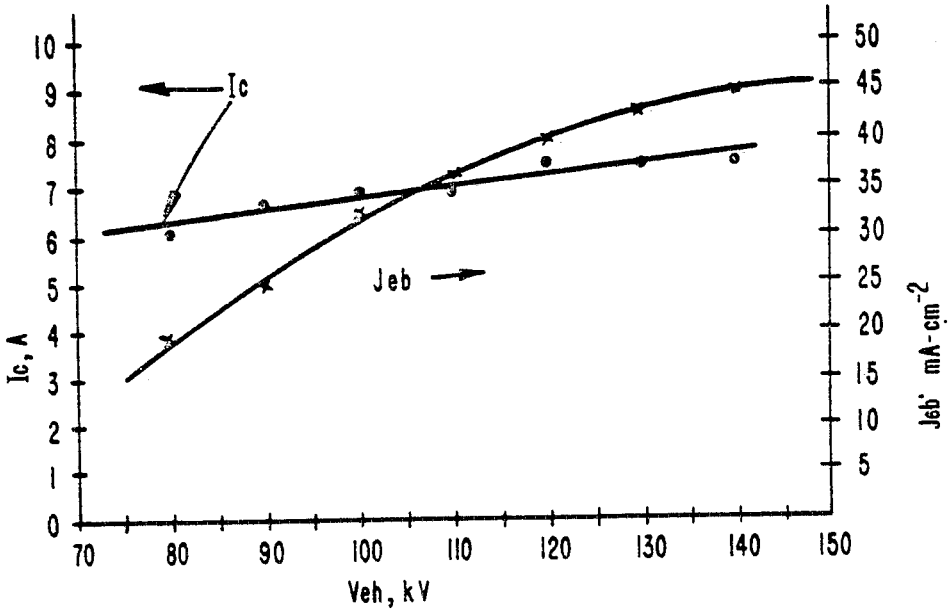
FIG. 3*a* and 3*b* are graphs of measured data for the planar EBCS of FIG. 2, plotting the WIP E-gun cathode current and electron beam current density as a function of the WIP E-gun voltage and the wire-anode current, respectively.

The present invention comprises a novel Electron Beam Controlled Switch (EBCS) and Wire-Ion-Plasma Electron-gun (WIP E-gun). The following description of representative embodiments of the invention is provided to enable any person skilled in the art to make and use the invention. Various modifications to these embodiments will be readily apparent to those skilled in the art, however, and the generic principles defined herein may be applied to other embodiments.

One aspect of the invention is the radial geometry of the WIP E-gun. Another aspect is the integration of this WIP E-gun into an EBCS of radial design. The radial geometry of the EBCS is illustrated in the conceptual perspective illustration of FIG. 1. Inner cylinder 10 serves as the WIP E-gun cathode. Cylindrical grid or mesh 15 serves as the WIP E-gun anode. An array of fine wire anodes 20 runs substantially the length of cylinders 10 and 15. Foil support cylinder 25 carries the foil windows which also serve as the switch anode. Outer cylinder 30 is a heavy metal negative electrode which serves as the switch cathode.

The ionization chamber of the WIP E-gun comprises annular region 40 between foil support cylinder 25 and grid 15. A gas under low pressure, typically Helium at 20 mTorr, is provided in the annular region 40 and the annular gap 35 between grid 15 and inner cylinder 10. The annular region 45 between foil support cylinder 25 and outer cylinder 30 comprises the pressurized switch cavity, typically filled with methane at four atmospheres.

The WIP E-gun cathode is biased at a large negative potential relative to the WIP E-gun anode so as to accelerate ions, produced in the ionization chamber, through gap 35 to bombard the cathode 10.

The invention works in the following manner. A voltage pulse is applied to the wire anodes to ionize the Helium gas in the ionization chamber. The resulting Helium ions are extracted through the E-gun anode grid and are accelerated through a high voltage, typically on the order of 150 kV, and bombard the E-gun cathode. Electrons are emitted from the emissive surface of cathode 10 (typically molybdenum) by secondary emission. The electrons emitted from the ion bombardment are accelerated outwardly by the high voltage through the ionization chamber windows and into the high pressure gas in the switch cavity. The high energy electrons ionize the high pressure gas between the switch anode and cathode, thereby turning "ON" the switch. In the absence of the electron beam, the switch gas deionizes and switch conduction is quickly extinguished.

For switch operation at currents of up to 10-kA and at a switch voltage range of 50–100 kV, typical dimensions for the structure are 10 cm for the radius of the WIP E-gun cathode, 16 cm as the radius of the ionization chamber grid 15, 20 cm as the radius of the foil support structure 25, 25 cm as the radius of the outer cylinder 30, and 15 cm as the length of the respective cylinders.

The EBCS in accordance with the invention will be superior to other types of switches for many pulse power applications. For example, the WIP E-gun component provides a means of controlling the "ON" and "OFF" state of voltage with a control pulser (for the wire anodes) operating at ground potential. The WIP E-gun requires a gas source but eliminates the need for cathode heater power, heater supply, grid pulser operating at high voltage, and the need to maintain a sensitive high temperature cathode so that it remains active in a harsh environment.

There are many advantages resulting from the radial ordering of the switch elements. The radial geometry of the invention is understood to provide the most compact switch design for a given rating. A design goal is to achieve a dense source of ions to impact the E-gun cathode. The wire anodes in the ionization chamber generate the ions in an annular region whose diameter is larger than the WIP E-gun cathode. Therefore, the ion density increases as the ions are focused and accelerated into the E-gun cathode. There is a gain (typically about 14); for electron emission at the E-gun cathode; therefore, many electrons result for each impacting ion. As the electrons are accelerated outwardly, the electron beam density decreases, but it is important to note that the switch cavity electron density required for conduction is much less than the available emission density.

The switch requires a large active area, as a typical switch current density is 10 A/cm$^2$, and for a 10-kA switch, an active switch area of about 1000 cm$^2$ is required. Therefore, with the switch cavity on the outside, an optimum sizing results.

A further advantage of the radial geometry of the invention is the minimization of X-ray shielding considerations. Since the window foil and support structure is buried deeply within the switch structure, the X-ray shielding requirement is minimized.

The radial geometry of the invention was implemented utilizing test results obtained by testing a test-model planar EBCS employing a WIP E-gun. A schematic of this planar configuration is shown in FIG. 2. This test circuit includes an outer enclosure 205, WIP E-gun cathode 210, plasma (ionization) chamber 215, grids 220, 225, 230 (switch anode), foil support 235, foil 240, and switch cathode 250.

The amplitude of the wire-anode-current pulse ($I_{wa}$) is determined predominantly by the internal impedance of pulse generator 255. $I_{wa}$ is typically 5 to 15 A for this test circuit and maintains a diffuse discharge within the ionization chamber 215. Typical discharge pulses ($V_{wa}$) are 200 to 400 V during conduction. Higher voltage pulses up to approximately 2 kV are required initiate wire anode ionizaition.

The WIP E-gun-cathode current ($I_c$) has a parametric dependence on the gas pressure in the WIP E-gun and the ion bombardment-emission ratio, but is determined mainly by $I_{wa}$ and the voltage applied to the WIP E-gun cathode ($V_{eb}$). The portion of $I_c$ that is transmitted through the grids, foil support and foil is the E-beam current ($I_{eb}$).

Figure 3B:
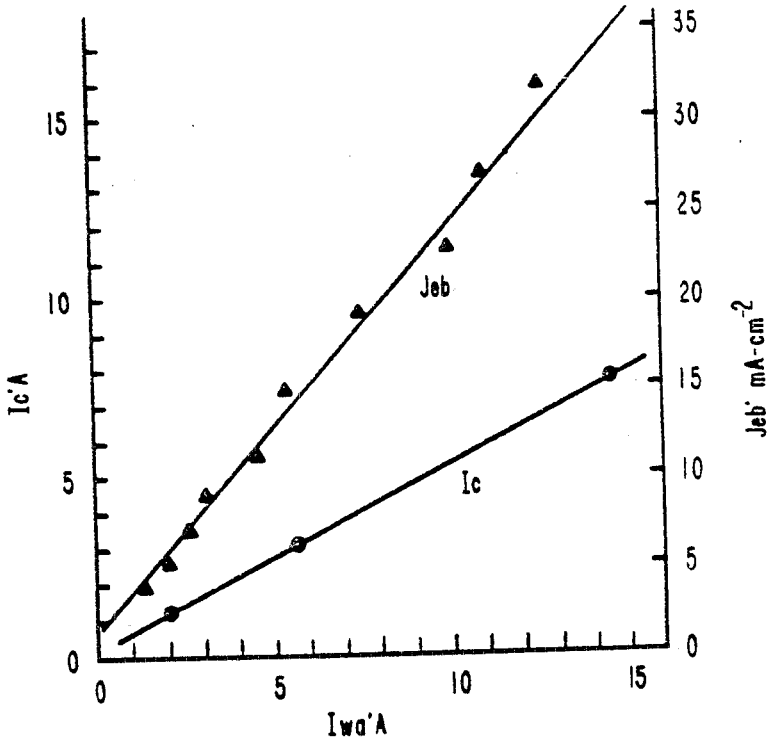

For proper application of the WIP E-gun with the switch cavity, the relationship of the E-beam current density ($J_{eb}$) to both $I_{wa}$ and $V_{eb}$ are required. These relationship were measured in the planar test model and are shown in FIGS. 3*a–b*, where both $I_c$ and $J_{eb}$ are plotted versus $V_{eb}$ and $I_{wa}$, respectively.

Figure 4A:
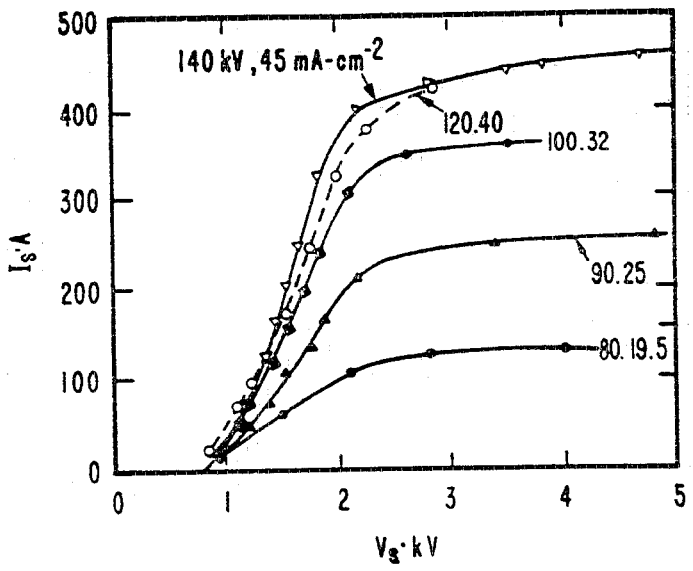
FIG. 4*a* and 4*b* are graphs of measured data for the planar EBCS of FIG. 2, illustrating the current-conducting characteristics of this device.
Figure 4B:
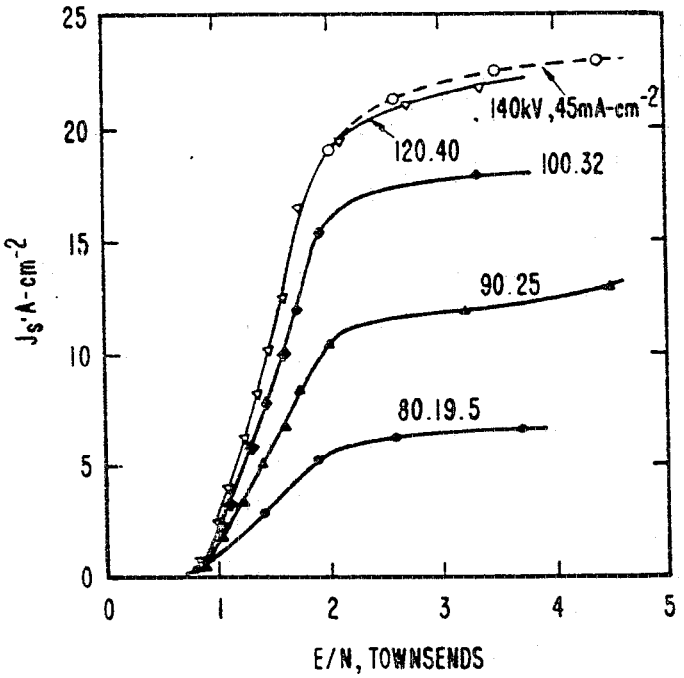

The current-conducting characteristics of the planar test model EBCS are illustrated with the data of FIGS. 4*a–b*. These data were taken by increasing $V_{eb}$ to increase $J_{eb}$ and with $I_{wa}$ fixed at 14.5 A. Additional test conditions were: switch-cathode-anode gap (d)=4 cm, switch gas=methane at 1 atm, effective foil window area=20 cm$^2$, and foil window=0.0013-cm-thick Titanium. The data show that switch current $I_s$ greater than 400 A or switch current density $J_s$ greater than 20

A/cm$^2$ are obtainable at conduction voltages between 1 and 2 kV. FIG. 4*b* uses the same experimental data as are plotted in FIG. 4*a*. However, in FIG. 4*b*, the data are reduced to show the switch current density $J_s$ versus E/N where E is the mean field gradient and N is the methane density. The curves of FIG. 4*b* are useful for tradeoff comparisons regarding choices for $J_s$, $V_s$, switch-electrode gap and pressure.

Figure 5:
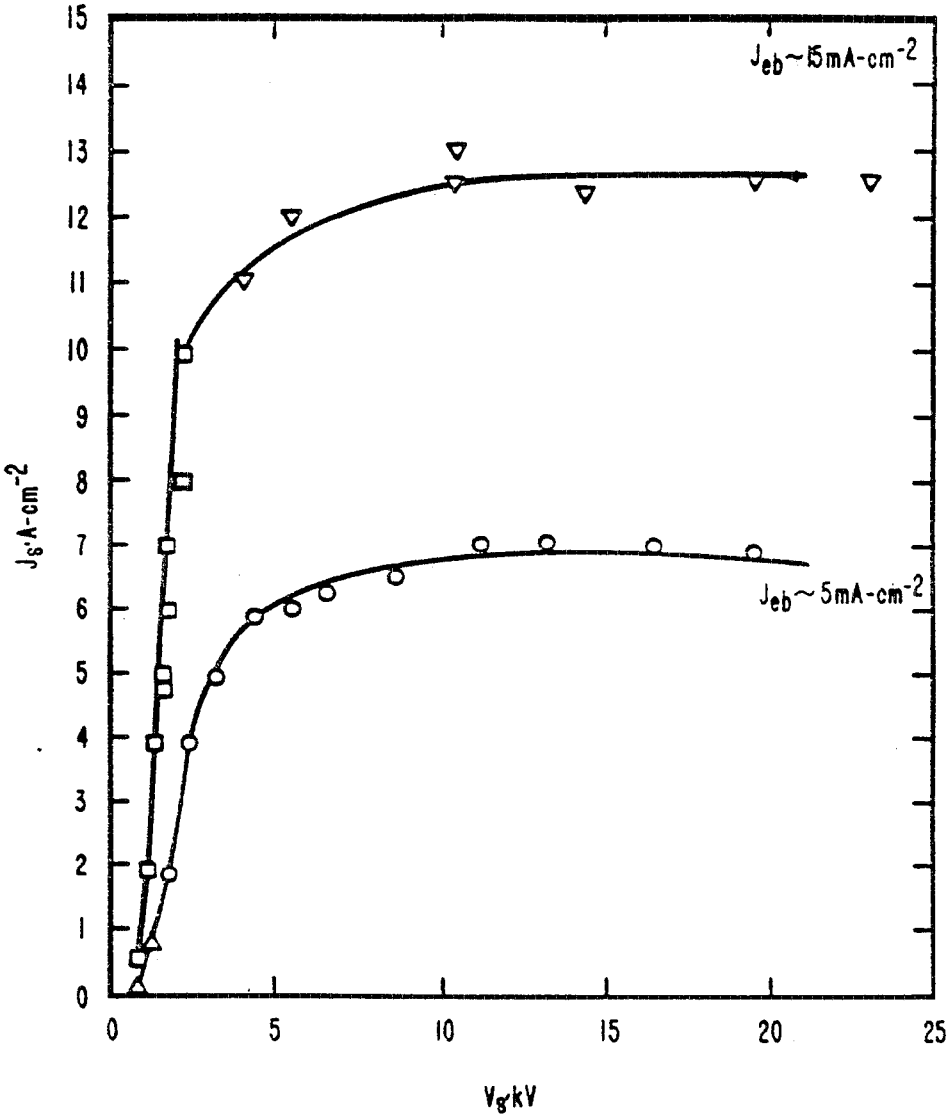
FIG. 5 is a graph of measured data for the planar EBCS of FIG. 2, plotting the switch current density as a function of switch voltage.

FIG. 5 shows $J_s$ versus $V_s$ for two values of $J_{eb}$of 5 and 15 mA-cm$^{-2}$. The beam voltage was fixed at 120 kV and $J_{eb}$ was set by varying $I_{wa}$. The data of FIGS. 4 and 5 showed that the design objective of $J_s$=10 A-cm$^{-2}$is attainable.

Figure 6:
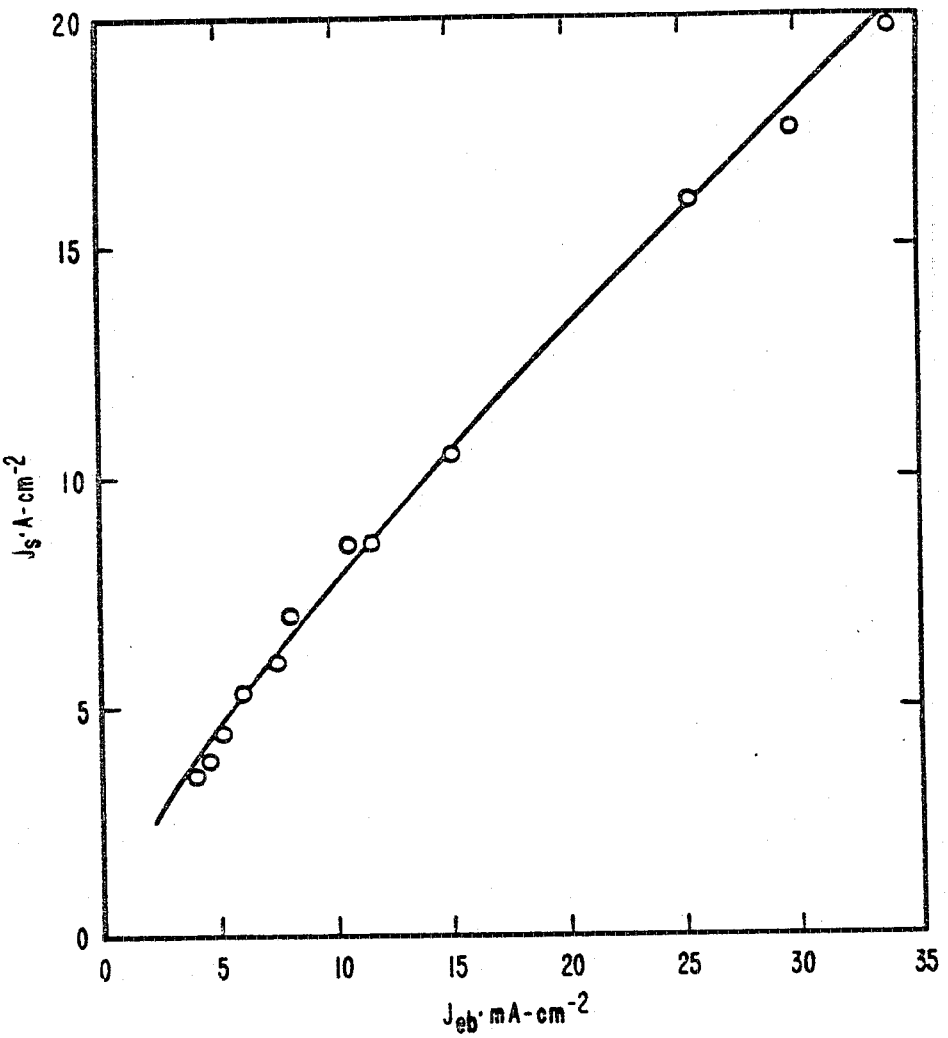
FIG. 6 is a graph of measured data for the planar EBCS of FIG. 2, illustrating the current gain characteristics of the device.

The current gain, $G=J_s/J_{eb}$, is illustrated by the plot of $J_s$ versus $J_{eb}$ of FIG. 6. These data are for $V_{eb}$=120 kV, d=4 cm, 1 atm of methane and $V_s$=10 kV, which is a value of $V_s$ that is well out into the $I_s$ saturation region. The gain varies from 600 to 900 depending on the value of $J_{eb}$. The gain measured is higher than would be expected from the theory that predicts a square root dependence of $J_s$ on $J_{eb}$ (see FIG. 6). The gain may be increased by increasing $V_{eb}$beyond 120 kV.

Figure 7:
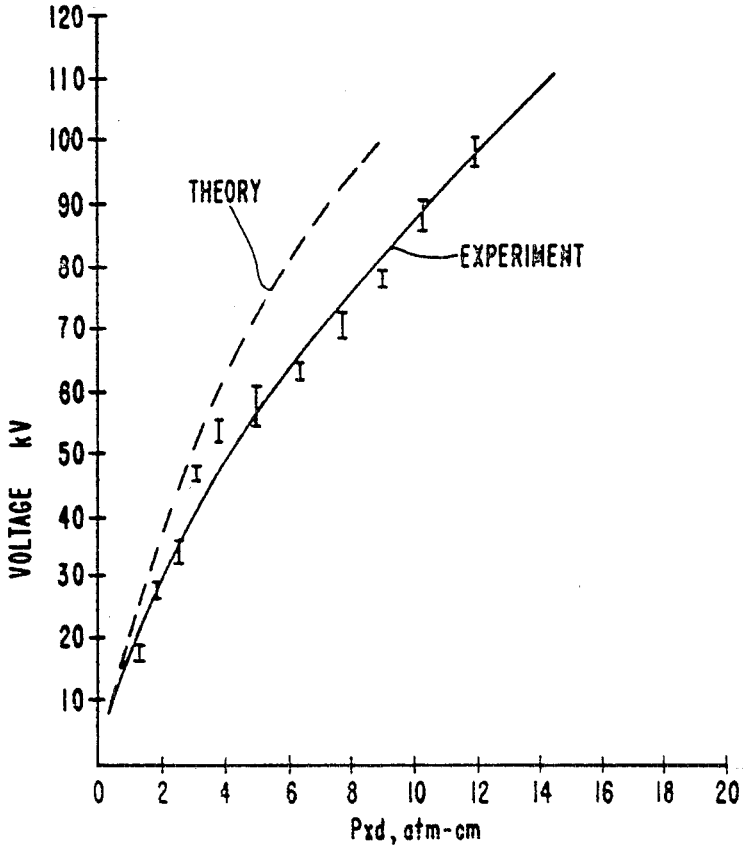
FIG. 7 illustrating voltage breakdown data for the planar EBCS of FIG. 2.

FIG. 7 illustrates voltage breakdown data for methane gas. The data shows that, to meet a holdoff voltage objective of 50 to 100 kV, the required pressure-switch-electrode distance product is up to 18 atm-cm. This pressure-gap spacing is expected to provide a margin of safety for both the cases of dc insulation and for the time periods immediately following a pulse.

Figure 8:
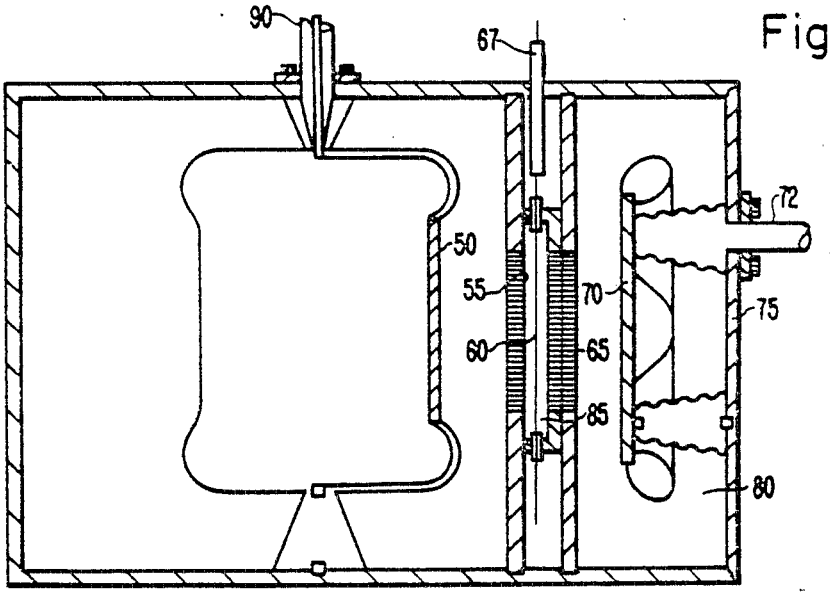
FIG. 8 is a simplified cross section view of an EBCS in accordance with the invention.

FIG. 8 is a partial longitudinal cross-sectional view of a EBCS switch in accordance with the invention, illustrating additional features of the radial geometry. High voltage E-gun bushing 90 is coupled at the center line of the switch to the E-gun cathode structure 50. Annular region 85 between cylindrical E-gun grid 55 and foil assembly 65 serves as the E-gun ionization chamber. An array of wire anodes 60 is disposed in the ionization chamber, coupled to an external ionization voltage source (not shown) by lead 67. Cylindrical switch cavity 80 is defined by the cylindrical foil assembly 65, which serves as the switch anode, and outer cylinder 75. Outer cylinder 75 serves as the pressure vessel wall. Switch cathode 70 is provided with a cable lead 72 to couple to the external switched circuit. The switch shown in FIG. 8 operates in the manner described above with respect to the conceptual diagram of FIG. 1.

Figure 9A:
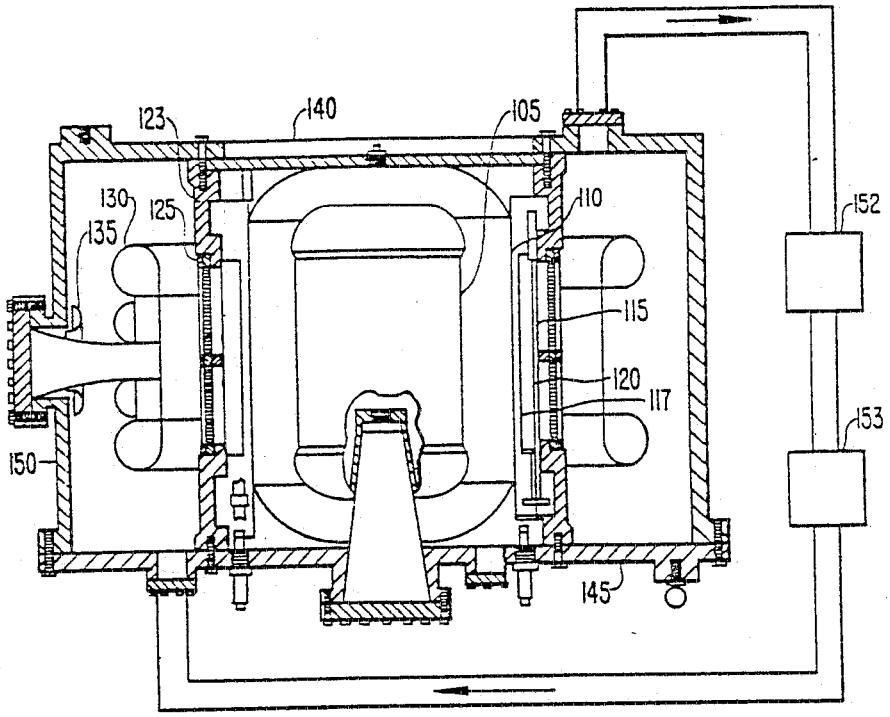
FIG. 9*a* is a cross sectional view of the preferred embodiment of the EBCS of the present invention.
Figure 9C:
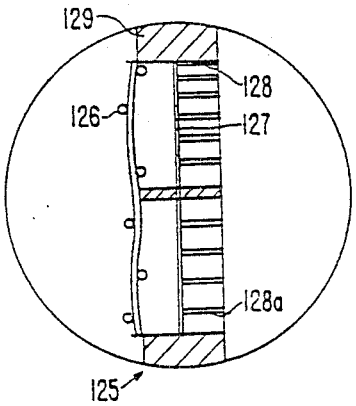
FIG. 9*b* is partial cross sectional top view of the preferred embodiment of the EBCS of the present invention.
Figure 9B:
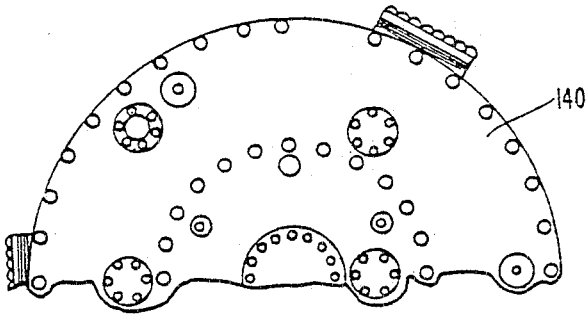
Figure 10:
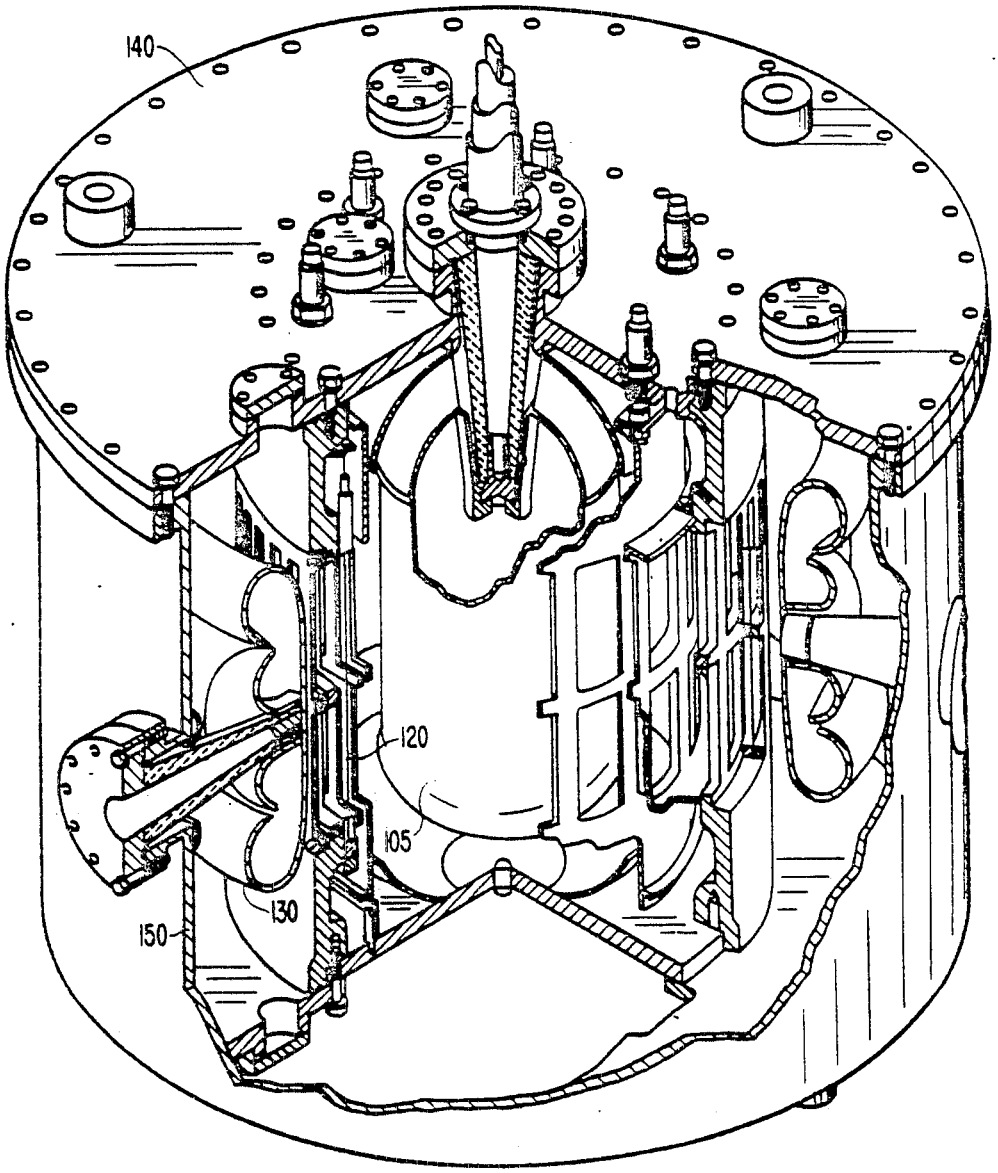
FIG. 10 is a partial isometric cutaway view of the preferred embodiment of the EBCS of the present invention.

Referring now to FIG. 9*a*, 9*b* and 10, a preferred construction of an EBCS employing the invention is disclosed. The switch geometry is cylindrical with the radially emitting WIP E-gun cathode on the centerline. WIP E-gun cathode 105 comprises a cylindrical structure. The auxiliary grid 110 is a cylindrical grid which serves as the WIP E-gun anode. Auxiliary grid 110 and ionization chamber grid 117 are cylindrical grid structures whose functions are described in the co-pending application entitled "Wire-Ion-Plasma Electron Gun Employing Auxiliary Grid," Ser. No. 621,420. A cylindrical array of eighteen wire anodes 120 is disposed in the ionization chamber 115, defined by the auxiliary grid 110 and the window foil structure 125. One wire anode is centered in each of eighteen foil window regions. Each wire anode runs substantially the length of the foil windows. All of the windows are aligned, one with the other, with the auxiliary grid 110, ionization chamber grid 117, and the window-support cylinder 123. The window-support cylinder 123 holds the foil support structure 128, foil 127, and, the switch anode screen 126, and its support 129. The foil support structure 128 comprises a plurality of thin rib members **128*a*** which support the foil against the pressure differential between the switch cavity and the WIP E-gun ionization chamber.

The switch cathode 130 is supported on radial-feedthrough bushing 135, rated to above 100 kV. The bushing on the centerline holds the WIP E-gun cathode and is rated to 200 kV. Ports are provided for feeding helium into and pumping out of the WIP E-gun cavity, and for flowing gas through the switch cavity 160 which could be pressurized at over four atmospheres. A pressurized gas blower 152 and filter 153 are provided to filter out particulates in the switch gas, as switch operation generates carbon particulates which must be filtered out.

Upper and lower plates 140, 145 are disposed at the ends of outer cylinder 150 and serve to provide supporting structure and partially define the pressure vessel for the gas envelopes for the E-gun and switch.

The WIP E-gun cathode and anode, the wire-anode array, and the switch cathode comprise concentric cylindrical structures.

FIG. 10 is an isometric-cutaway view of the EBCS shown in FIGS. 9*a*, 9*b*. This switch has the following dimensions for a 10-kA switch:

WIP E-gun cathode diameter: 20.3 cm
Size of annular gap between E-gun cathode and E-gun anode: 5.1 cm
Spacing between switch anode and cathode: 4.5 cm
Height of Switch outer cylinder/pressure vessel: 50.2 cm
Diameter of switch outer cylinder/pressure vessel: 81.3 cm
Spacing between switch cathode and pressure vessel vall: 6.0 cm
Height of switch cathode: 21.6 cm The switch of the invention will find application in radar applications, pulsers for particle accelerators and high power lasers, fusion reactors and the like. The switch is expected to be rated at higher current, voltage and repetition rates than any other type of switch. Perhaps the most significant advantages of the switch is its ability to turn "OFF" under load, i.e., against a high voltage. The switch has the capability to interrupt current without a natural current zero and without using a commutation scheme or crowbar circuit.

While the preferred embodiment of the switch employs the E-gun cathode at the center of the switch, and the switch cathode adjacent the outer periphery of the switch, these positions could be reversed. Thus, an alternative embodiment of the invention could employ the WIP E-gun on the outer portion of the switch, with th switch cathode and anode disposed interior relative the WIP E-gun. The switch anode and cathode polarities could also be inverted.

It is understood that the above-described embodiment is merely illustrative of the many possible specific embodiments which can represent principles of the present invention. Numerous and varied other arrangements can readily be devised in accordance with these principles by those skilled in the art without departing from the spirit and scope of the invention.

What is claimed is:

1. An electron-ion plasma source employing radial geometry, comprising:

a gas envelope, adapted to contain a gas under relatively low pressure;

cathode electrode disposed within said gas envelope and comprising a substantially cylindrical emissive surface;

an array of wire anodes;

substantially cylindrical grid disposed within said gas envelope between said cathode and said array of wire anodes;

means for selectively coupling an ionization potential to said array of wire anodes, whereby upon application of said potential to said wire anodes, said gas is ionized in the region adjacent said wire anodes;

means for providing a large potential difference between said cathode and said grid member, whereby ions are extracted through said grid means to bombard said cathode, causing emission of electrons therefrom which are accelerated by said large potential difference through said grid.

2. The invention of claim 1 wherein said cathode electrode and said grid are concentrically disposed about a common axis.

3. The invention of claim 2 wherein said cathode comprises an inner cylindrical structure, whereby ions generated in the region adjacent said wire anodes are extracted inwardly to impact said cathode.

4. The invention of claim 3 wherein said array of wire anodes comprises a plurality of elongated wire elements each running substantially the length of said cathode and grid members.

5. The invention of claim 4 wherein said elongated wire elements are equally spaced and disposed equidistant from said cathode.

6. The invention of claim 1 wherein said gas envelope comprises foil windows respectively aligned with said array of wire anodes, said foil windows adapted such that said emitted electrons tunnel through said foil windows.

7. A switch system controlled by an electron beam and employing a radial geometry, comprising:

a hollow outer switch electrode member;

an inner switch electrode member disposed within said outer electrode member;

gas envelope means for enveloping said inner and outer electrode members and adapted to contain an ionizable switch gas within an annular switch cavity region disposed between said switch electrodes, wherein conduction between said switch electrodes is supported when said switch gas is ionized to form a conductive plasma, and said switch electrodes are electrically isolated from each other when said gas is not ionized;

means for introducing a beam of high energy electrons into said switch cavity region to ionize said switch gas and form said plasma; and means for turning said electron beam on and off by application of a relatively low potential and thereby respectively ionizing the switch gs to close the switch when the beam is turned on and allowing the plasma to decay to open the switch when the beam is turned off.

8. The system of claim 7 wherein said means for introducing said electron beam comprises an electron gun having an ionization chamber containing an electron gun ionization gas and at least one wire anode for selectively ionizing the gas in the ionization chamber, and wherein said means for turning said electron beam on and off comprises said wire anode for selectively ionizing the gas in the ionization chamber in response to application of said relatively low potential.

9. The system of claim 7 wherein said inner and outer electrode members comprise substantially cylindrical surfaces concentrically arranged on a common center axis.

10. The system of claim 8 wherein said gas envelope means comprises window means adapted to allow penetration of said high energy electrons therethrough.

11. The system of claim 10 wherein said means for turning said electron beam on and off comprises means for selectively applying said ionization potential to said wire anodes of said electron gun.

12. The system of claim 10 wherein said window means comprises an electron transmissive foil window aligned in relation to said wire anode.

13. An electron-beam-controlled switch employing a radial geometry with an electron gun to provide the controlling electron beam, comprising:

an electron gun cathode comprising a substantially cylindrical inner structure having an electron emissive surface;

an electron gun anode comprising a substantially cylindrical outer grid structure, said cylindrical structure of said cathode being disposed within said outer cylindrical structure of said anode;

means for defining a first gas envelope about said anode and cathode for containing an electron gun ionization gas, said envelope means comprising a substantially cylindrical foil support structure carrying electron transmissive foil windows comprising a first switch electrode, said foil structure and said cylindrical grid structure arranged to define a substantially annular electron gun ionization chamber;

an array of wire anodes disposed within said electron gun ionization chamber;

means for selectively applying a relatively low ionization potential to said wire anodes for selectively ionizing said electron gun gas to produce a plasma containing positive ions;

means for applying a large negative potential to said electron gun cathode for extracting positive ions from said chamber to bombard said cathode, thereby generating secondary electrons which are repelled radially outwardly by said large potential through said foil windows;

a second switch electrode comprising an outer cylindrical structure disposed outside of said first switch electrode; and means for defining a substantially annular switch ionization chamber between said first and second switch electrodes, said chamber adapted to contain a switch ionization gas, whereby said switch gas is selectively ionized by said secondary electrons to provide a conductive plasma coupling the first and second switch electrodes when the ionization potential is applied to said wire anodes, and said plasma quickly decays when the ionization potential is turned off, so that conduction between the switch electrodes is no longer supported.

14. The switch of claim 13 wherein said electron gun cathode, said cylindrical grid structure, said foil support structure and said switch cathode are concentrically arranged about a switch center axis.

15. The switch of claim 14 wherein said first gas envelope means is partially defined by said inner cylindrical structure comprising said electron gun cathode and said foil support structure, said first gas envelope means adapted to contain said electron gun ionization gas under relatively low pressure.

16. The switch of claim 15 wherein said first gas envelope means is further defined by first and second lateral plate members extending from said inner cylindrical structure comprising said electron gun cathode to said foil support structure at opposing ends thereof.

17. The switch of claim 15 further comprising means for applying an ionization potential to said wire anode array, such that the gas in said first envelope is ionized when said ionization potential is applied to said wire anode array.

18. The switch of claim 17 further comprising means for applying a large potential difference between said electron gun anode and said electron gun cathode, wherein ions in said ionization chamber are accelerated through said potential to bombard said electron gun cathode.

19. The switch of claim 18 wherein said foil support structure is adapted to support an array of foil electron transmissive windows substantially aligned with said wire anodes.

20. The switch of claim 19 further comprising a second gas envelope partially defined by said foil support structure and said outer cylinder, said second gas envelope adapted to contain a second gas under pressure.

21. The switch of claim 19 wherein said means for defining said switch ionization chamber further comprises said first and second plate members, which are further adapted to extend from said foil support cylinder to said outer cylinder at opposing ends thereof.

22. The switch of claim 19 wherein said ion bombardment causes emission of electrons from said electron gun cathode, which electrons are accelerated by said potential difference between said electron gun cathode and said electron gun anode through said foil windows into said switch ionization chamber, thereby ionizing said switch ionization gas and causing conduction of said switch.

* * * * *